US005860306A

United States Patent [19]

Daehn et al.

[11] Patent Number: 5,860,306

[45] Date of Patent: Jan. 19, 1999

[54] ELECTROMAGNETIC ACTUATOR METHOD OF USE AND ARTICLE MADE THEREFROM

[75] Inventors: Glenn S. Daehn; Vincent J. Vohnout; Amit A. Tamhane, all of Columbus, Ohio

[73] Assignee: The Ohio State University, Columbus, Ohio

[21] Appl. No.: 825,777

[22] Filed: Apr. 2, 1997

[51] Int. Cl.[6] ..... B21D 1/06

[52] U.S. Cl. ..... 72/56; 72/707; 29/419.2

[58] Field of Search ..... 72/56, 705, 707; 29/419.2

[56] References Cited

U.S. PATENT DOCUMENTS

| | | | |
|---|---|---|---|
| 3,975,936 | 8/1976 | Baldwin et al. | 72/38 |
| 3,992,773 | 11/1976 | Duffner et al. | 29/628 |
| 3,998,081 | 12/1976 | Hansen et al. | 72/56 |
| 4,026,628 | 5/1977 | Duffner et al. | 339/177 |
| 4,049,937 | 9/1977 | Khimenko et al. | 219/7.5 |
| 4,067,216 | 1/1978 | Khimenko et al. | 72/56 |
| 4,135,379 | 1/1979 | Hansen et al. | 72/56 |
| 4,143,532 | 3/1979 | Khimenko et al. | 72/56 |
| 4,148,091 | 4/1979 | Hansen et al. | 361/156 |
| 4,151,640 | 5/1979 | McDermott et al. | 29/605 |
| 4,169,364 | 10/1979 | Khimenko et al. | 72/56 |
| 4,531,393 | 7/1985 | Weir | 72/56 |
| 4,619,127 | 10/1986 | Sano et al. | 72/56 |
| 4,947,667 | 8/1990 | Gunkel et al. | 72/56 |
| 4,962,656 | 10/1990 | Kunerth et al. | 72/56 |
| 4,986,102 | 1/1991 | Hendrickson et al. | 72/56 |
| 5,046,345 | 9/1991 | Zieve | 72/56 |
| 5,331,832 | 7/1994 | Cherian et al. | 72/56 |
| 5,353,617 | 10/1994 | Cherian et al. | 42/56 |
| 5,405,574 | 4/1995 | Chelluri et al. | 419/47 |
| 5,442,846 | 8/1995 | Snaper | 29/419 |
| 5,457,977 | 10/1995 | Wilson | 72/56 |
| 5,471,865 | 12/1995 | Michalewski et al. | 72/430 |

OTHER PUBLICATIONS

Moon, F.C., Magneto–Solid Mechanics, (1984).

ASTME, High Velocity Forming of Metals, revised edition (1968).

Michael M. Plum, "Electromagnetic Forming", Forming Processis for Sheet, Strip, and Plate, pp. 645–652.

Belyy, I.V., et al., Electromagnetic Metal Forming Handbook, Kar'kov State University, Khar'kov, USSR (1977).

Michael C. Noland, Designing For The High–Velocity Metalworking Processes, Design Guide, pp. 164–182, 1967.

Fenton, G. et al., Modeling of Electromagnetically Formed Sheet Metal, (1996).

Daehn, et al., "High–Velocity Metal Forming—An Old Technology Addresses New Problems".

Balanethiram et al., "Enhanced Formability Of Interstitial Free Iron At High Strain Rates", Formability of Fe, vol. 27, pp. 1783–1788, 1992.

Gourdin, "Analysis and assessment of electromagnetic ring expansion as a high–strain–rate test", J. Appl. Phys. vol. 65, No. 2, pp. 411–422, 1989.

Balanethiram et al., "Hyperplasticity: Increased Forming Limits At High Workpiece Velocity", Forming Limits, vol. 30, pp. 515–520, 1991.

Hu et al., "Effect Of Velocity On Flow Localization In Tension", Acta metall. mater. vol. 00, No. 0 pp. 1–13, 1995.

Altynova et al., "Increased Ductility In High Velocity Electromagnetic Ring Expansion", pp. 1–32.

*Primary Examiner*—David Jones

*Attorney, Agent, or Firm*—Standley & Gilcrest

[57] ABSTRACT

One of the key features of the present invention is the use of a electrical conduit arrangement that allows for the tailoring of the magnetic field so as to provide for the greater amount of force to be brought to bear generally in the center of the work force area. The present invention provides for such capability by providing for a single central current conduit for forming longitudinally extending work pieces. The present invention also provides for the splitting, and/or direction (or curvature) reversal, of the electrical current pulse one or more times to likewise tailor the magnetic field of the work-coil or forming actuator.

29 Claims, 10 Drawing Sheets

ELECTROMAGNETIC ACTUATOR METHOD OF USE AND ARTICLE MADE THEREFROM

TECHNICAL FIELD OF THE INVENTION

This invention relates to improved designs of work-coils used in electromagnetic forming. More specifically, the invention relates to coil designs wherein the current is split one or more times, or reversed in coil direction, thereby creating work-coils that are less prone to mechanical failure and create electromagnetic pressure distributions that are better suited for forming sheet metal. This invention has a variety of applications including forming large conductive sheet metal, such as that which may be used in automobile manufacture.

BACKGROUND OF THE INVENTION

Electromagnetic forming is a method of forming sheet metal or thin walled tubes that is based on placing a work-coil in close proximity to the metal to be formed and running a brief, high intensity current pulse through the coil. If the metal to be formed is sufficiently conductive the change in magnetic field produced by the coil will produce eddy currents in the work piece. These currents also have associated with them a magnetic field that is repulsive to that of the coil. This natural electromagnetic repulsion is capable of producing very large pressures that can accelerate the work piece at high velocities (typically 10–200 meters/second). This acceleration is produced without making physical contact to the work piece. The electrical current pulse is usually generated by the discharge of a capacitor bank. This field has been developed by many individuals and companies and is widely used for the forming and assembly of tubular and sheet work pieces. Several excellent reviews of the field are available, including Moon, F. C., Magneto-Solid Mechanics, ASTME, High Velocity Forming of Metals, revised edition (1968); Plum, M. M., Electromagnetic Forming, Metals Handbook, Maxwell Laboratories, Inc., pp. 644–653; and Belyy, I. V., Fertik, S. M. and Khimenko, L. T., Electromagnetic Metal Forming Handbook, Khar'kov State University, Khar'kov, USSR (1977) (Translation from Russian by M. M. Altoynova 1996), all of which are hereby incorporated herein by reference. Examples of prior art patents involving electromagnetic forming include U.S. Pat. No. 4,947,667 to Gunkel et al., U.S. Pat. No. 4,531,393 to Weir aet al., U.S. Pat. No. 5,353,617 to Cherian et al., U.S. Pat. No. 3,998,081 to Hansen et al., U.S. Pat. No. 5,331,832 to Cherian et al., U.S. Pat. No. 5,457,977 to Wilson, U.S. Pat. No. 4,619,127 to Sano et al., U.S. Pat. No. 4,473,862 to Hill, U.S. Pat. No. 4,151,640 to McDermott et al. and U.S. Pat. No. 5,016,457 to Richardson et al., all of which are hereby incorporated herein by reference.

Electromagnetic forming can be carried out on a wide range of materials and geometries within some fundamental constraints. First, the material must be sufficiently electrically conductive to exclude the electromagnetic field of the workcoil. The physics of this interaction have been well characterized.

Another key constraint is coil strength. Generally equal and opposing external forces will exist on the work-coil and work piece. In addition, the current that runs through the coil can induce large internal transient forces that are separate with the repulsion from the work piece. These can also lead to coil failure. In the development of electromagnetic forming coils the issue of robustness has generally been addressed by wrapping what is often called a 'field-shaper' with many windings of coil from the power source. The main mechanical forces are transmitted through the massive field shaper which accepts the pressure from the work piece acceleration. This concept is used to make the 'wafer coils' which are generally acknowledged to produce the highest pressures from production coils designed for thousands to hundreds of thousands of operations without a rebuilding procedure. In many other designs the deformation of the work coil or fracture of insulation and arcing usually causes the coils to fail after a number of operations. That number is set roughly by the construction of the coil and the average energy of the operations performed.

To date, all of the coils that have been reported to have been used for electromagnetic forming typically have had roughly cylindrical symmetry, such as shown in schematic form in FIG. 1. FIG. 1 shows a standard unidirectional coil through which the current pulse is passed from the positive pole 11 to the negative pole 12. The coil 10 is supplied with a current pulse from a power source which typically is a simple bank of capacitors with appropriate charging circuitry and discharge bus work, as is well-known in the art (not shown).

The most common such coils are those based on simple solinoidal windings used for the expansion or compression of tubes. Less common, but still abundantly mentioned in the literature, are 'pancake coils' that use a flat spiral geometry. Such coils are commonly used to form bulge-like features in flat metal sheets. These coils do suffer from limited strength and as a result of this a number of specialized coils using massive field shapers have been developed and are taught in the art. Both field shaper geometry and the standard flat spiral geometry are limited in that the magnetic pressure drops to zero at the center of the actuator.

As shown in FIG. 1A, a cross-section along line 1A—1A of FIG. 1, the magnetic field produced in the work-force area has a area of weakness in the center of the work-force area. Careful analyses have been performed on the flat spiral coil (G. Fenton, N. Takatsu, M. Kato, K. Sato and T. Tobe, JSME International Journal, 31, 142 (1988)) which show that the magnetic pressure is actually a maximum at the outer edge of the coil. This is a distinct disadvantage in most practical cases as the maximum displacement and force are generally desired at the center of work-force area adjacent the coil.

Secondly, such a geometry is disadvantageous because all of these coils are typically based on circular symmetry. This makes it very difficult to envision ways to form many shapes such as those including elongated features or those with complicated shapes which may be extended from the plane of the work piece.

Accordingly, it is desirable to be able to produce electromagnetic actuators that can provide maximum force and displacement and force at the center of the actuator coil, and which can be produced in robust arrangements that resist and maximize mechanical stress in the forming operation. It is also desirable to provide an actuator that produces a relatively uninterrupted magnetic field over the region where forming is desired.

It is also advantageous to be able to produce electromagnetic actuators that can be conveniently applied to the formation of elongated metal pieces, as well as the formation of other metal shapes of a wide variety of geometries.

It is also an object of the present invention to eliminate some of the drawbacks in the prior art by allowing one to tailor the spatial distribution of pressure more effectively and by permitting the building of stronger, more robust coils (i.e., typically of thicker conduit cross-section) to balance internal magnetic forces.

The present invention also has as its goal to allow one to produce electromagnetic actuators that provide more uniform force distribution and/or force distribution that are tailored to suit the geometry of the component being formed.

The present invention also allows such actuators to be more easily incorporated into, and used with, molds, forming dies and tool bodies.

In view of the following disclosure, other advantages of the invention, and the solution to other problems using the invention, may become apparent to one of ordinary skill in the art.

SUMMARY OF THE INVENTION

One of the key features of the present invention is the use of a electrical conduit arrangement that allows for the tailoring of the magnetic field so as to provide for the greater amount of force to be brought to bear generally in the center of the work force area. The present invention provides for such capability by providing for a single central current conduit for forming longitudinally extending work pieces. The present invention also provides for the splitting, and/or direction (or curvature) reversal, of the electrical current pulse one or more times to likewise tailor the magnetic field of the work-coil or forming actuator.

While the prior art was based on the use of concentric, unidirectional coils, the present invention makes possible the production of electromagnetic actuators that may be tailored to a wide variety of geometries, including elongated shapes. The principal benefit of such pulse splitting (and/or direction reversal) is that the actuator may produce a work-force distribution in the work-force area (that area served by the actuator) that concentrated or otherwise arranged about the center (for actuators of relatively equilateral geometry such as multi-coil or polygonal geometries) or about its longitudinal axis for elongate actuators or about some other feature direction (where maximum force is desired in a particular region). The actuators of the present invention do not have the disadvantages associated with prior art actuators such as centrally discontinuous work-force distributions, such as those brought about by concentric, unidirectional coils of the prior art.

Generally speaking, the magnetic field produced by actuators of the present invention is relatively stronger in the relative center portion of the work-force area than in the relative side portions of the work-force area. In this regard, reference to "relative center" and "relative sides" is intended in a general sense, intending to refer to the magnetic field produced by actuators of the present invention, whether the actuator has one or several degrees of symmetry. Also, one may wish to maximize field strength at the interior of the coil but not at the center. The central current conduit and the at least two return current conduits may form a substantially symmetrical or asymmetrical work-force area, although the size and shape of the work-force area may be determined according to the desires of the operator and the requirements of the work piece to be formed, as shown by the examples provided herein.

In accordance with the present invention, there is disclosed several variations of the present invention, methods of its use, and metal pieces formed using the inventive apparatus and method in their many embodiments.

One of the most fundamental embodiments of the present invention includes an apparatus for forming a metal work piece, said apparatus comprising:

(a) an electromagnetic actuator comprising a central current conduit, said central current conduit adapted to conduct a current pulse, and extending longitudinally so as to conduct a current pulse along a linear or arcuate path, and a return current conduit adapted to conduct said current pulse to an electrical ground; and (b) a current power source adapted to produce a current pulse through said electromagnetic actuator so as to produce a magnetic field.

The central conduit may be in the form of a mold body defining a mold shape against which the metal work piece is deformed.

The current pulse may be guided along a linear or arcuate path in order to conform to the desired final or intermediate shape of the metal work piece to be form. Typically, if an arcuate path is used, it will be of an arc of 180 degrees or less, although greater arcs less than 360 degrees may be used.

The apparatus may additionally include a work piece holder adapted to hold the metal work piece alongside the central current conduit and in such proximity to the central current conduit such that the magnetic field causes the deformation of said metal work piece. The work piece holder may also comprise a mold body defining a mold shape against which the metal work piece is deformed. The work piece holder can be a mold body comprising a first half adapted to fit along a first side of the actuator so as to hold the metal work piece between the actuator and the first half, and a second half adapted to fit along a second side of the actuator opposite the first side.

The present invention also includes a method of forming a metal work piece using the actuator of the present invention as summarized herein. The method generally comprises steps:

(a) obtaining a metal work piece having an original shape;

(b) disposing the metal work piece in the work force area of an electronic actuator, said actuator comprising:

(i) an electromagnetic actuator comprising a central current conduit, the central current conduit adapted to conduct a current pulse, and extending longitudinally so as to conduct a current pulse along a linear or arcuate path, and a return current conduit adapted to conduct the current pulse to an electrical ground; and (ii) a current power source adapted to produce a current pulse through the electromagnetic actuator so as to produce a magnetic field; and (c) causing a current pulse to pass through the actuator, the current being sufficient to produce a magnetic field of sufficient strength to deform the metal work piece from the original shape to another shape.

The present invention also includes a metal work piece formed from an original shape into another shape in accordance with the method of the present invention as summarized herein.

The apparatus of another embodiment of the present invention includes an apparatus for forming a metal work piece which features a split current conduit, and which comprises: (a) an electromagnetic actuator comprising a central current conduit, the central current conduit adapted to conduct a current pulse, and adapted to divide the current pulse so as to provide a divided current pulse, and a return current conduit adapted to conduct the divided current pulse to an electrical ground; and (b) a current power source adapted to produce a current pulse through the electromagnetic actuator so as to produce a magnetic field.

The cross-section of the current conduit used in the present invention may be of any geometrical shape, as exemplified in the accompanying figures and description.

The invention is thus not limited to any particular geometrical shape of the cross-section, and may be selected from any desired shape such as flat, round, square or other polygonal or irregular shapes. Also, the return path may be fabricated from a monolithic section (such as a die) that encompasses both sides of the conduit.

The apparatus of the present invention may also have a central current conduit and at least two return current conduits which have at least one of the following characteristics: (1) the central current conduit and the at least two return current conduits are substantially co-planar, (2) the at least two return current conduits form substantially planar coils in which each may have multiple windings, (3) the central current conduit and the at least two return current conduits are linear and substantially co-planar, (4) the central current conduit and the at least two return current conduits are linear, substantially co-planar and parallel, and (5) the central current conduit and the at least two return current conduits are curvilinear and substantially parallel. The central current conduit and the at least two return current conduits may form an elongate work-force area having a longitudinal axis extending substantially parallel to the central current conduit.

As one alternative, the central current conduit may also be adapted to divide the current pulse by being in the form of a mold body defining a mold shape against which the metal work piece is deformed. Such mold body may be in the form of mated male and female mold body portions.

The actuators of the present invention may have the central current conduit and the two or more return current conduits that form either a substantially symmetrical work-force area or an asymmetrical work-force area.

The power source may be selected from any power source capable of providing a current pulse of sufficient strength and duration to induce a work-force appropriate to form the work piece into the desired shape. Such parameters are well known to those skilled in the art, and capacitor banks used in such actuators are well-known in the art. Examples include current pulses in the range of 5KA-100KA amps for times in the range of 1–100 milliseconds. For instance, the current power source may be in the form of a charged capacitor bank.

The apparatus of the present invention may also have a work piece holder to hold the work piece during forming. Such a work piece holder may be in the form of a female mold body or a male mold body defining a mold shape against which, or into which, the metal work piece is deformed. The apparatus may also have a work piece holder which comprises a first half adapted to fit along a third side of the actuator (where the return conduits are on respective first and second sides) so as to hold the metal work piece between the actuator and the first half, and a second half adapted to fit along a fourth side of the actuator opposite the third side.

Any of the actuators of the present invention described herein may also be used with an apparatus for forming a metal work piece into a target shape, the apparatus comprising: (a) a male mold portion having a mold side and a back side; (b) a female mold portion having a mold side and a back side; the mold side of the male mold portion and the mold side of the female mold portion adapted to mate incompletely so as to deform a work piece disposed therebetween so as to form the work piece into a precursor shape, leaving at least one precursor area of the work piece to be finally formed; (c) at least one electromagnetic actuator disposed on one of the mold portions and opposite the at least one precursor area; and (d) a current power source adapted to produce a current pulse through the at least one electromagnetic actuator, so as to produce a magnetic field in the at least one precursor area so as to deform the at least one precursor area into a target shape.

Any of the actuators of the present invention described herein may be used with the methods of the present invention.

The present invention includes a method of forming a metal work piece comprising the steps of: (a) obtaining a metal work piece, the work piece having an original shape; (b) disposing the metal work piece in the work force area of an electronic actuator, the actuator comprising:

(i) an electromagnetic actuator comprising a central current conduit, the central current conduit adapted to conduct a current pulse, and adapted to divide the current pulse so as to provide a divided current pulse, and at least two return current conduits adapted to conduct the divided current pulse to an electrical ground; and (ii) a current power source adapted to produce a current pulse through the electromagnetic actuator, so as to produce a magnetic field in a work force area on the third side of the central current conduit;

(c) causing a current pulse to pass through the actuator, sufficient to produce a magnetic field of sufficient strength to deform the metal work piece from the original shape to another shape.

In another embodiment, the present invention includes a method of forming a metal work piece comprising the steps: (a) obtaining a metal work piece, the work piece having an original shape; (b) disposing the metal work piece in the work force area of an electronic actuator, the actuator comprising:

(i) an electromagnetic actuator comprising a central current conduit, the central current conduit adapted to conduct a current pulse in a first current direction and having first and second sides, and a third side perpendicular to a direction between the first and second sides, the central current conduit divided into at least two return current conduits, at least one of the at least two return current conduits extending along a first and second side of the central current conduit and adapted to conduct the current pulse in a second direction to an electrical ground; and (ii) a current power source adapted to produce a current pulse through the actuator, so as to produce a magnetic field in the work force area on the third side of the central current conduit;

(c) causing a current pulse to pass through the actuator, sufficient to produce a magnetic field of sufficient strength to deform the metal work piece from the original shape to another shape.

Such methods may be used in another method, that being a method of forming a metal work piece into a target shape, the method comprising the steps:

(a) obtaining a metal work piece, the work piece having an original shape;

(b) disposing the metal work piece in a mold comprising an electronic actuator, the mold comprising:

(i) a male mold portion having a mold side and a back side;

(ii) a female mold portion having a mold side and a back side;

the mold side of the male mold portion and the mold side of the female mold portion adapted to mate incompletely so as to deform a work piece disposed therebetween so as to form the work piece into a precursor shape, leaving at least one precursor area of the work piece to be finally formed so as to complete the target shape;

(iii) at least one electromagnetic actuator disposed on one of the mold portions and opposite the at least one precursor area; and (iv) a current power source adapted to produce a current pulse through the at least one electromagnetic actuator, so as to produce a magnetic field in the at least one precursor area so as to deform the at least one precursor area into a target shape;

(c) closing the mold sides upon the metal work piece so as to form the work piece into the precursor shape; and (d) causing a current pulse to pass through the actuator, sufficient to produce a magnetic field of sufficient strength to deform the metal work piece from the precursor shape to the target shape.

In yet another embodiment of the present invention there is included an apparatus for forming a metal work piece, the apparatus comprising:

(a) an electromagnetic actuator comprising a current conduit, the current conduit defining a current path having a shape, the shape comprising:

(i) a current pulse origin;

(ii) a first current coil portion coiling outward from the current pulse origin, the first current coil portion coiling in a first direction;

(iii) a direction reversing portion; and (iv) a second coil portion coiling inward to an electrical ground;

such that the direction of the current pulse carried by the direction reversing portion and those portions of the first and second coil portions that intersect a line connecting the current pulse origin and the electrical ground, are substantially parallel; and (b) a current power source adapted to produce a current pulse through the electromagnetic actuator, so as to produce a magnetic field.

The present invention also includes a method of forming a metal work piece, the method comprising the steps:

(a) obtaining a metal work piece, the work piece having an original shape;

(b) disposing the metal work piece in the work force area of an electronic actuator, the actuator comprising:

(i) an electromagnetic actuator comprising a current conduit, the current conduit defining a current path having a shape, the shape comprising:

(1) a current pulse origin;

(2) a first current coil portion coiling outward from the current pulse origin, the first current coil portion coiling in a first direction;

(3) a direction reversing portion; and (4) a second coil portion coiling inward to an electrical ground;

such that the direction of the current pulse carried by the direction reversing portion and those portions of the first and second coil portions that intersect a line connecting the current pulse origin and the electrical ground, are substantially parallel; and (ii) a current power source adapted to produce a current pulse through the electromagnetic actuator, so as to produce a magnetic field; and (c) causing a current pulse to pass through the actuator, sufficient to produce a magnetic field of sufficient strength to deform the metal work piece from the original shape to another shape.

It will be understood from the examples of the present invention given below that the actuator coils of the present invention may be of any geometry generally described herein. Accordingly, the actuator coils of the present invention may be of any regular or irregular geometry, such as forming such shapes as circular, ovoid, polygonal spirals. In accordance with the present invention, the actuator coils of the present invention may also be in the form that includes branching of multiple coils, as shown in the examples. Also, the coils may be confined to a plane, or their outward surface may be singly or doubly curved, or be even more complex, as desired.

DETAILED DESCRIPTION OF THE PREFERRED EMBODIMENTS

In accordance with the foregoing summary, the following presents several examples of actuators of various geometries which are considered to be the best modes of the invention for the embodiments they represent.

Three example applications of the patent electromagnetic forming actuator have been built and tested for experimental purposes.

Figure 2:
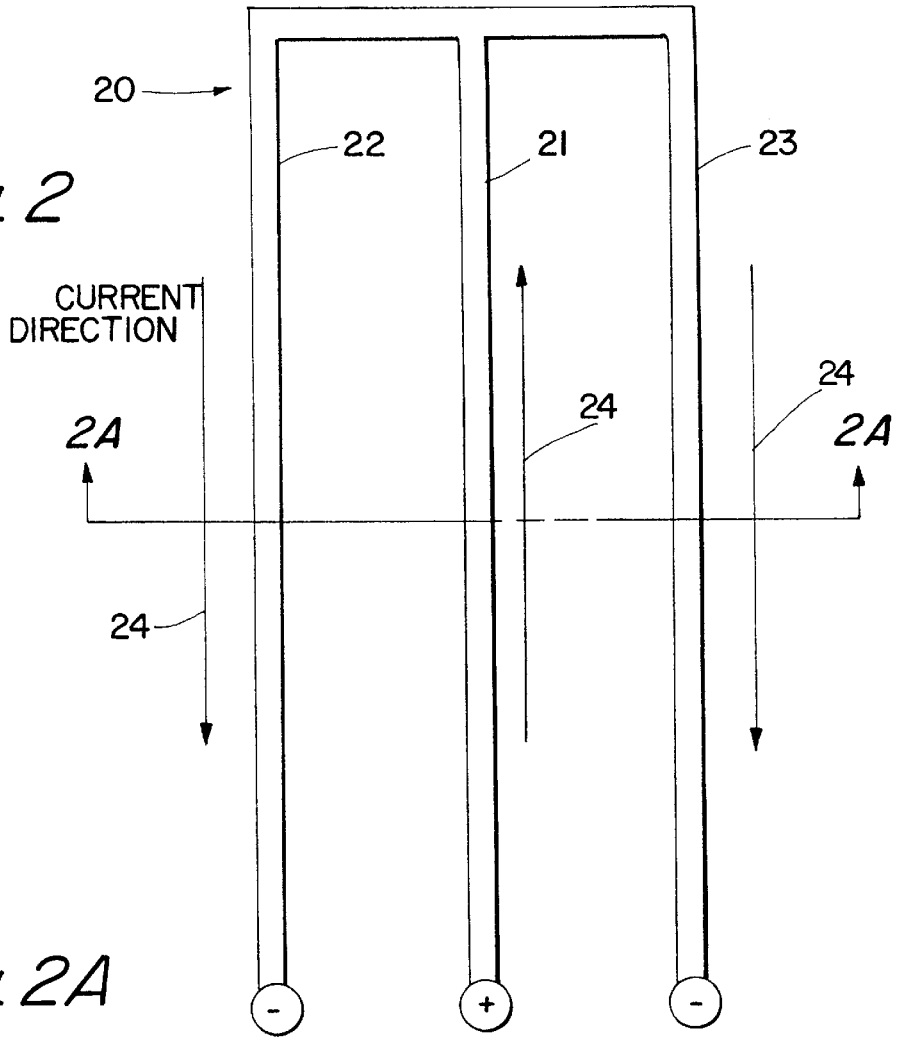
FIG. 2 is a plan view of an actuator coil in accordance with one embodiment of the present invention.

FIG. 2 shows a plan view of an actuator in accordance with one embodiment of the present invention.

FIG. 2 shows schematically the primary or simplest geometry for an actuator 20 of the present invention, consisting of three straight prismatic bar conductors of the same cross section, i.e., 0.375 by 0.750 inch. FIG. 2 shows central conduit 21 which is split to form return conduits 22 and 23 substantially parallel thereto. The conduits 21, 22 and 23 are mounted co-planar on the 0.375 inch sides and parallel on the 0.750 inch sides with a 0.375 inch separation between conductors. The structural and electrical connection is made at one end of the assembly by a through bolt using separation spacers of the same bar stock (not shown). The other end of the assembly is connected by right angle conductor pieces, to the double buss bar of Maxwell-Magneform 48KJ capacitor bank (not shown). The longer center conduit 21 is connected to the positive buss and the two shorter return conduits 22 and 23 are connected to the negative buss. Current direction is indicated by arrows 24 and the polarity indicated by the plus (+) and minus (−) signs. The total assembly length is approximately twenty (20) inches. The central twelve inches of the actuator is surrounded on three sides by an aluminum support channel (not shown) which reacts to the repulsive forces generated between the conducting bars of the actuator. The support channel is insulated from the actuator by 0.125 inch thick polycarbonate sheet. The top side of the actuator is flush with the top of the support channel assembly and covered by a 0.010 inch thick sheet of Mylar to insulate the actuator assembly from the work piece sheet which is placed atop the assembly. In this embodiment, the form tool for the test is then positioned on the test sheet centrally over the actuator assembly and weighted down with several heavy, one inch thick rubber pads prior to discharging the capacitor bank. It is also possible to incorporate such an actuator into a mold body by using a central conduit and a single return conduit in the form of a conductive body that is insulated from, but surrounds the central conduit on two or three adjacent sides, leaving a side to face the work force area. In such an embodiment, the current pulse is "split" by being diffused into the mass of the single return conduit in at least two divergent directions, ultimately returning to the negative bus.

Figure 2A:
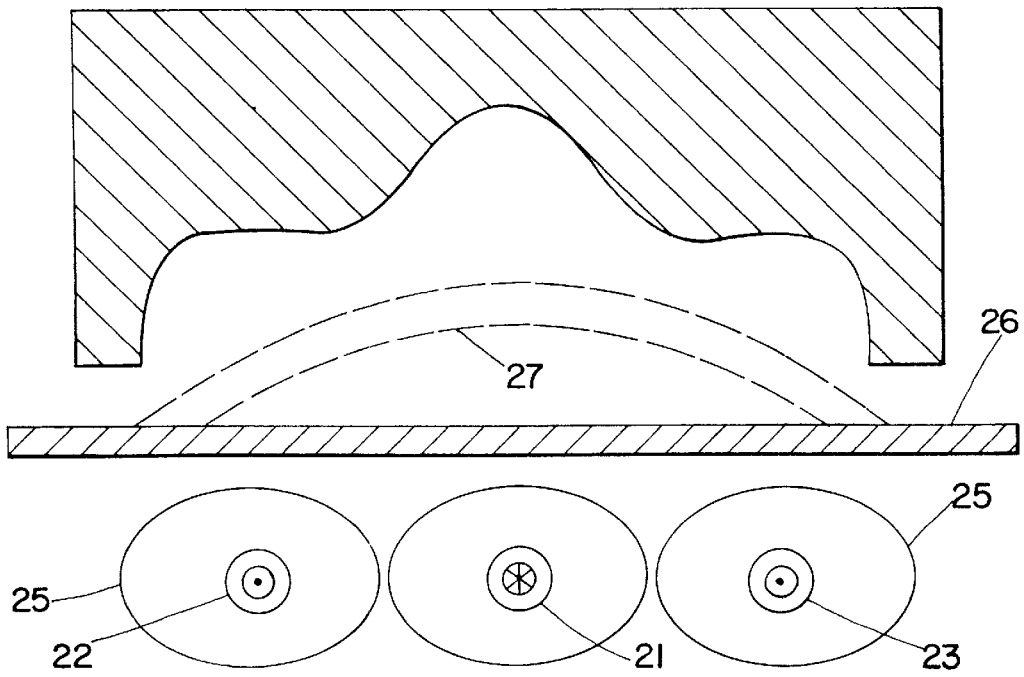
FIG. 2A is a cross-section of the actuator coil of FIG. 2 shown juxtaposed with a workpiece and a forming die.

FIG. 2A shows a cross-sectional view of the actuator 20 taken along line 2A—2A of FIG. 2. FIG. 2A shows a cross section of central conduit 21 and return conduits 22 and 23. FIG. 2A also shows a general indication of the magnetic force distribution as indicated by magnetic flux lines 25. The density of the flux line is related to the local electromagnetic force. FIG. 2A shows that the maximum displacement would not be effected in a work piece 26 as reflected by the magnetic force lines 25 when attempting to deform the work piece 26 as indicated by dotted lines 27. FIG. 2 also shows die 28 against which the work piece 26 may be formed (as may be the case with any of the embodiments of the present invention shown in the drawings).

An alternative embodiment, a coil assembly similar in construction to that of FIG. 2 is constructed, except that its working length is forty inches, has a face width of 1.5 inches and is curved in a plane perpendicular to the working face, to form a 120 degree included angle with a six inch radius at the angle apex. The coil is mounted in a plywood housing consisting of a sandwich of four thicknesses of 0.75 inch (nominal) finish grade interior plywood which is contoured to match the coils curvature. The coil is supported by the two center sheets of plywood which also react the primary pressure pulse generated by the coil. The two outer plywood sheets extend up along the sides of the outer coil conductors to react the separation forces between the three coil conductor and are contoured to be approximately flush with the working face of the coil assembly. The plywood sheets held together by several through bolts which also provide clamping pressure to secure the coil assembly in the channel formed by the shorter center sheets and longer outer sheets of plywood. The form tool is clamped in similar way in a plywood laminate assembly which forms a conjugate to the coil holder. The coil holder and tool holder are held together during forming by four threaded tie rods, nuts and simple, straight angle iron tie brackets. The assembled coil half and tool half form a rectangular plywood block approximately 24 by 36 inches and 3 inches thick. This experimental electromagnetic forming tool accepts a 40 inch long aluminum strip up to 6 inches thick and forms it into a 120 degree angle bracket with an integral stiffening rib along the center. The center rib has a cross-sectional shape defined by the form tool mounted in the upper plywood housing. Both stretch ribs (outside of the bracket) and compression ribs (inside of the bracket) can be formed by selecting the proper plywood halves to mount the coil and the form tool.

Figure 3:
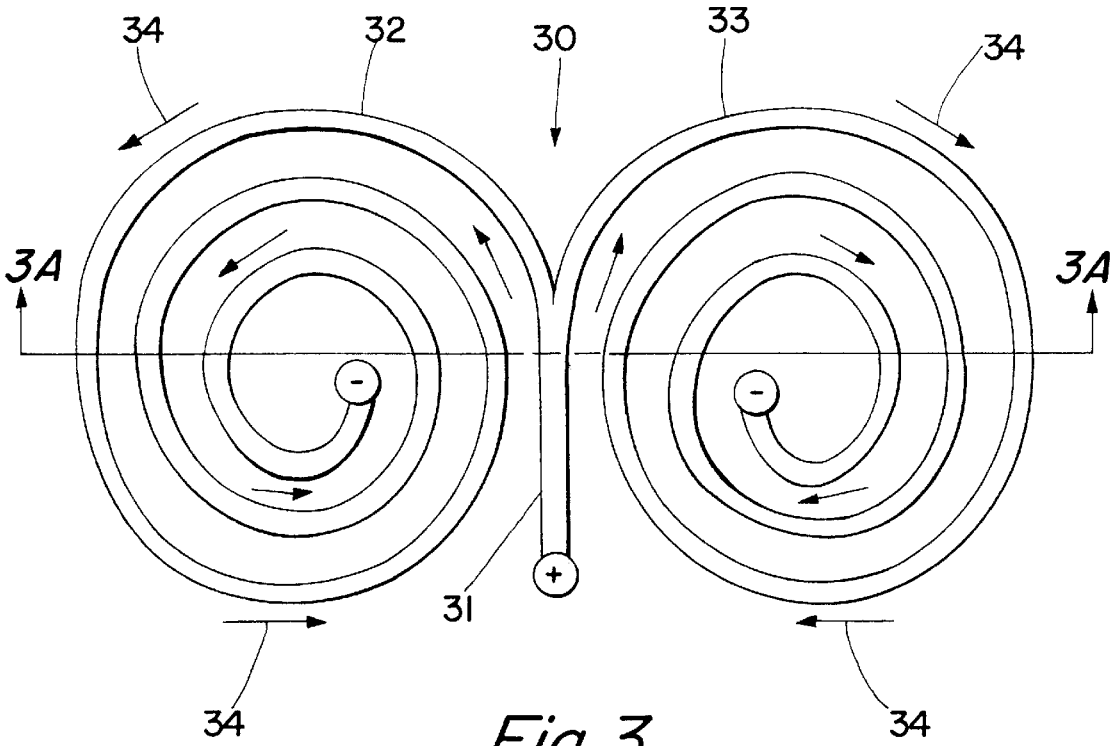
FIG. 3 is plan view of another actuator coil in accordance with another embodiment of the present invention.

FIG. 3 shows actuator coil 30 which has central conduit 31 which splits into two return conduits 32 and 33 which form inward turning coils. These coils may be co-planar with the return conduit and preferably are co-planar with the exception that the straight portions extending from the interior of each coil toward the negative (−) pole are shown as extending below the plane of the coils of the return conduits 32 and 33. The conduit 31 is connected to the positive bus and the return conduits 32 and 33 are connected to the negative bus. Current direction is indicated by arrows 34. It will be understood that FIG. 3 is merely an example of the geometry that could be used in such return conduit coils. Other geometries may include oval, ovoid, polygonal or irregular shapes, even without regard to the symmetry of the return conduit coils, according to the original and desired intermediate or final shape of the work piece, and the corresponding requirements of the shape and dimensions of the magnetic field to be applied. See FIG. 3B as an example.

Figure 1:
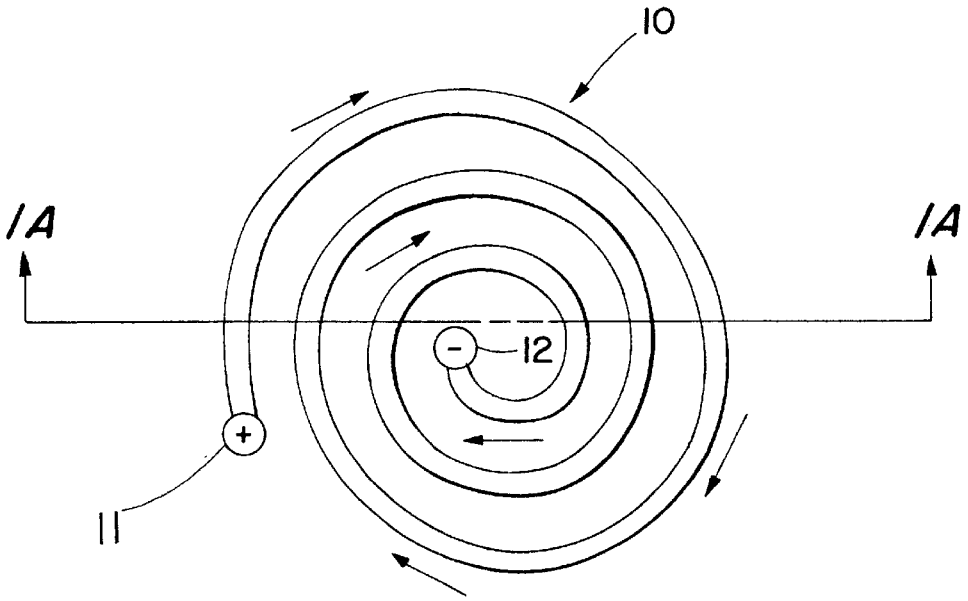
Fig. 1 (PRIOR ART)
FIG. 1 is the plan view of an actuator coil in accordance with the prior art.
Figure 1A:
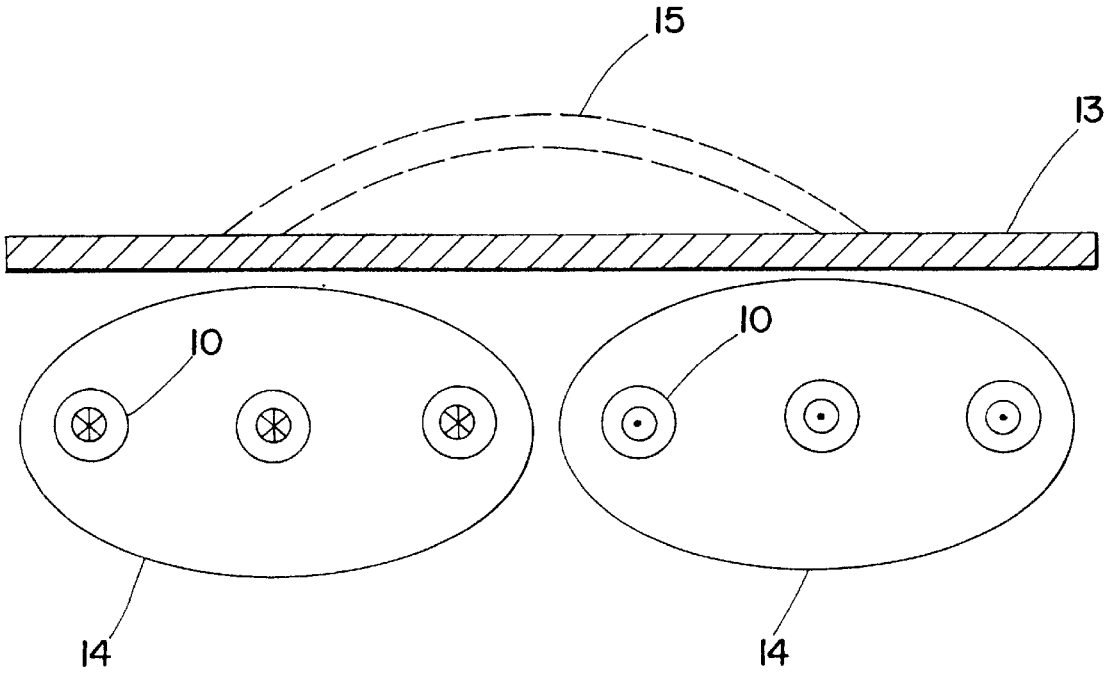
Fig. 1A (PRIOR ART)
FIG. 1A is a cross-section elevation of the coil shown in FIG. 1 shown juxtaposed with a workpiece, in accordance with the prior art.
Figure 3A:
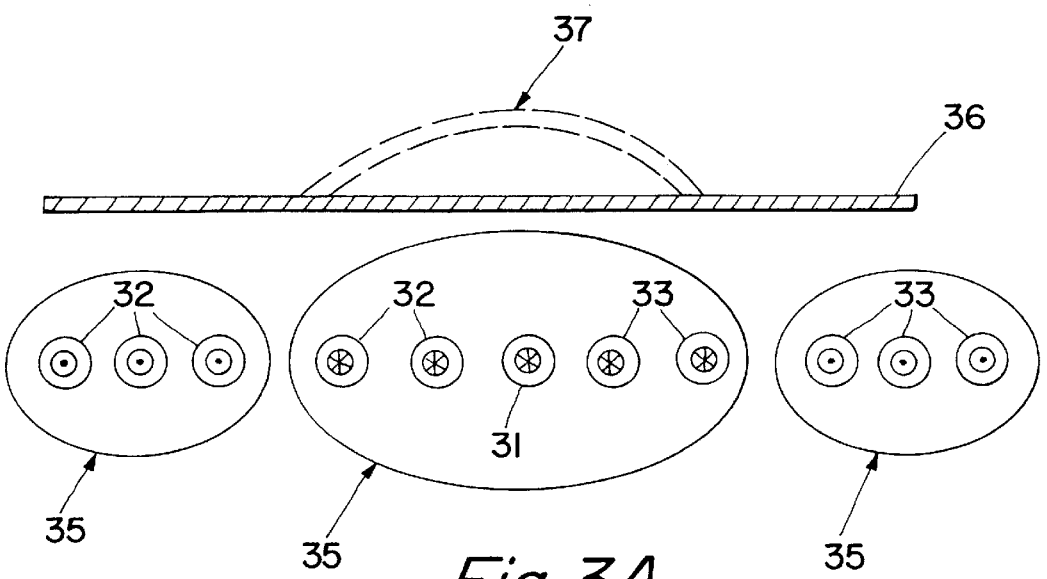
FIG. 3A is a cross-section of the actuator coil in accordance with FIG. 3 shown juxtaposed with a work piece.

FIG. 3A shows a cross-section taken along 3A—3A of FIG. 3. This Figure shows central conduit 31 and portions of return conduits 32 and 33. The magnetic field produced in the work-force area is indicated by general magnetic field lines 35. FIG. 3A shows that the maximum magnetic force would be effected in a work piece 36 when attempting to deform the work piece 36 as indicated by dotted lines 37. As in FIG. 1A and 2A, FIG. 3A indicates the direction of current flow by a single dot to indicate current flow out of the plane of the paper as presented to the reader while an asterisk design (*) indicates current flow into the plane of the drawing as viewed by the reader. Also, the work force area is that area generally perpendicular to the plane defined by the dotted lines and above (or below, as the case may be) the actuator indicated by the position of the work pieces in these Figures.

Figure 3B:
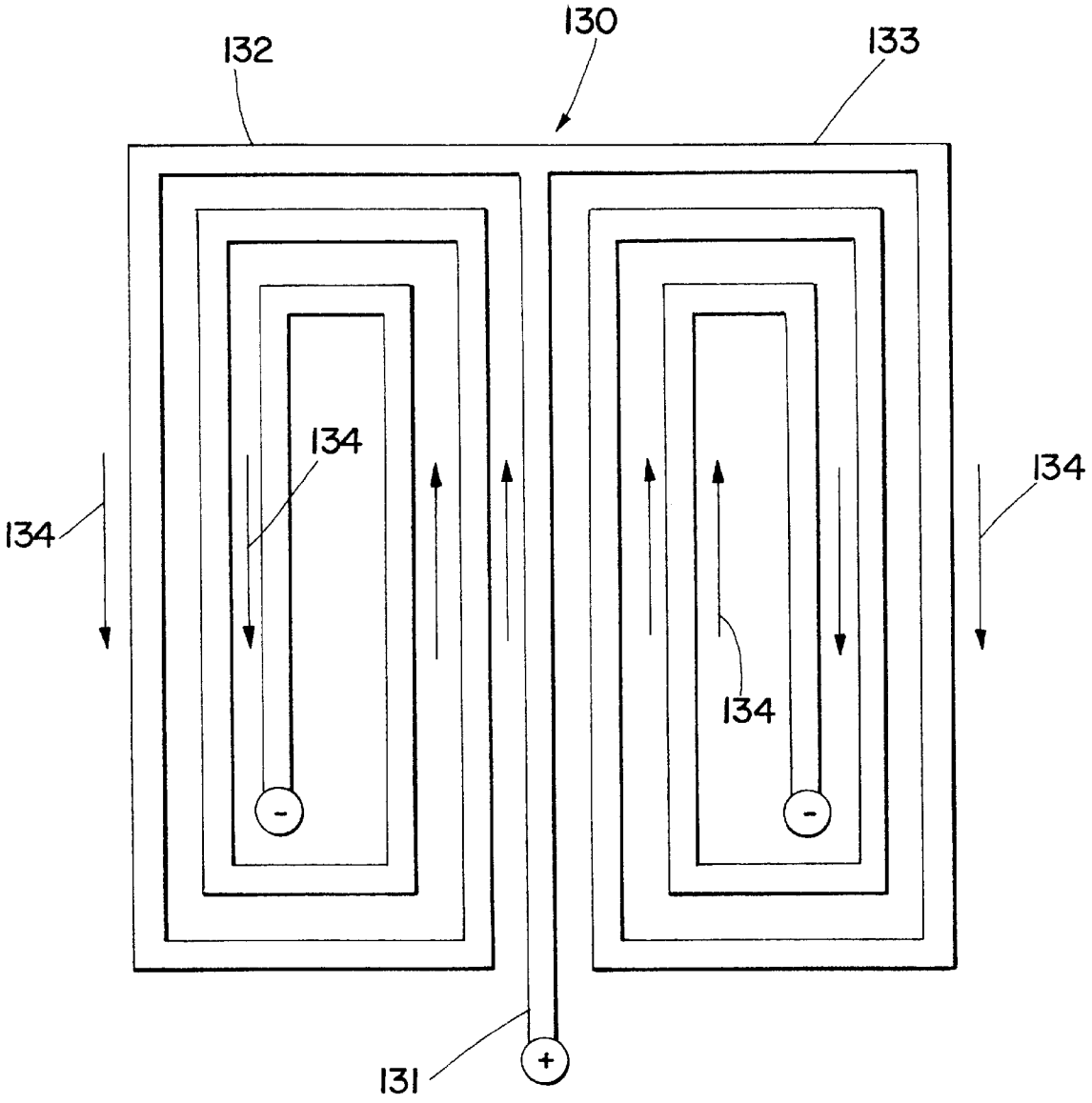
FIG. 3B is plan view of another actuator coil in accordance with another embodiment of the present invention.

FIG. 3B shows a variation of the actuator coil shown in FIG. 3, the embodiment of FIG. 3B showing a quadralateral geometry in the return conduit coils.

FIG. 3B shows actuator coil 130 which has central conduit 131 which splits into two return conduits 132 and 133 which form inward turning quadralateral coils. These coils may be co-planar with the return conduit and preferably are co-planar. The conduit 131 is connected to the positive bus and the return conduits 132 and 133 are connected to the negative bus. Current direction is indicated by arrows 134.

Figure 4:
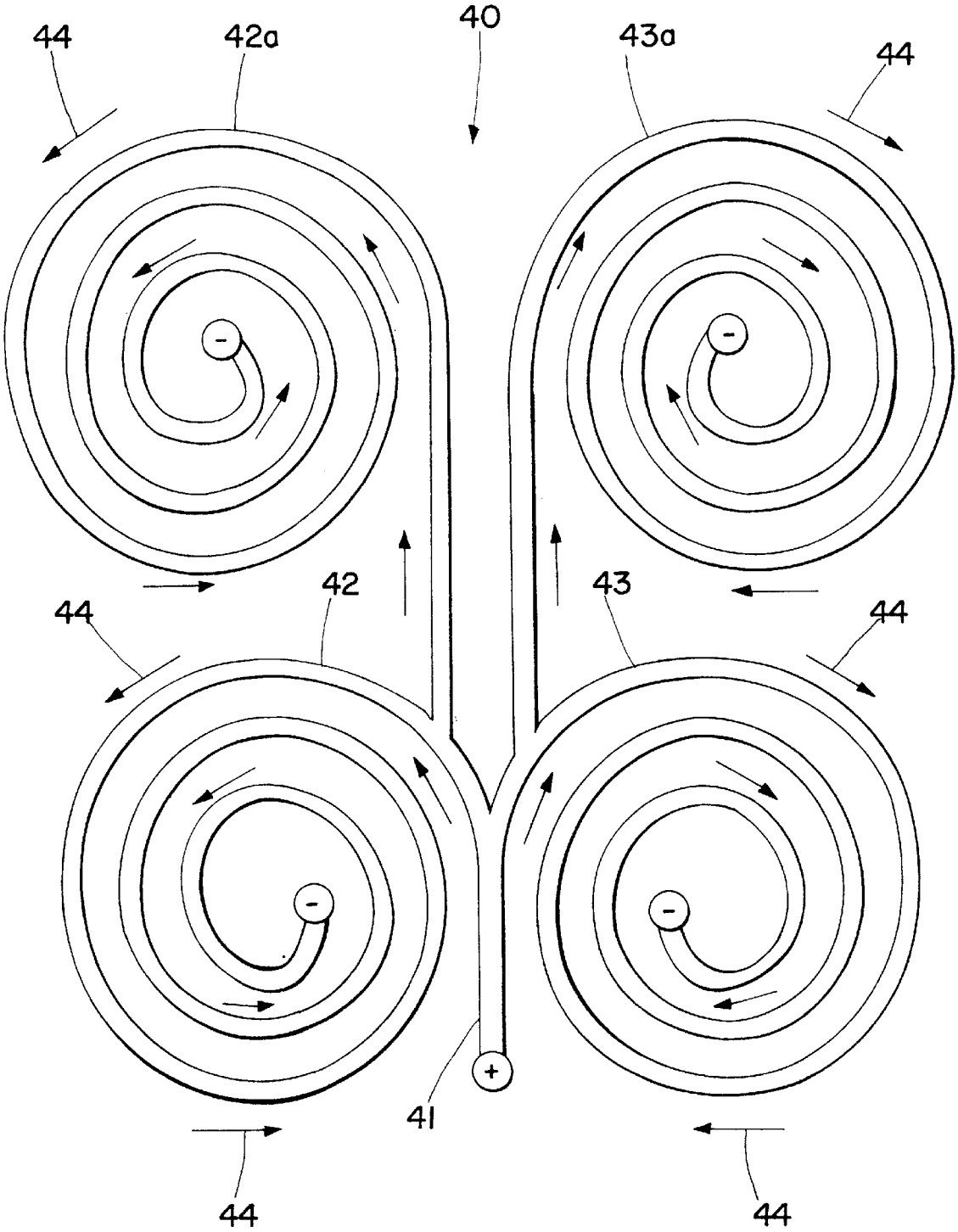
FIG. 4 is a plan view of yet another actuator coil in accordance with another embodiment of the present invention.

FIG. 4 shows yet another alternative embodiment of a geometry of an actuator coil in accordance with the present invention. FIG. 4 shows an actuator coil 40 comprising central conduit 41 which is split twice to form return conduit coils 42, 43, 42*a* and 43*a*. In this embodiment all four return coils are shown as being co-planar with the straight portions extending toward the negative bus from the interior of each coil extending below the plane of the four return coils. Such an embodiment gives a greater work force area but maintains high magnetic pressures through the central portion of the work force area similar to the field shown in FIG. 3A as described above.

Figure 4A:
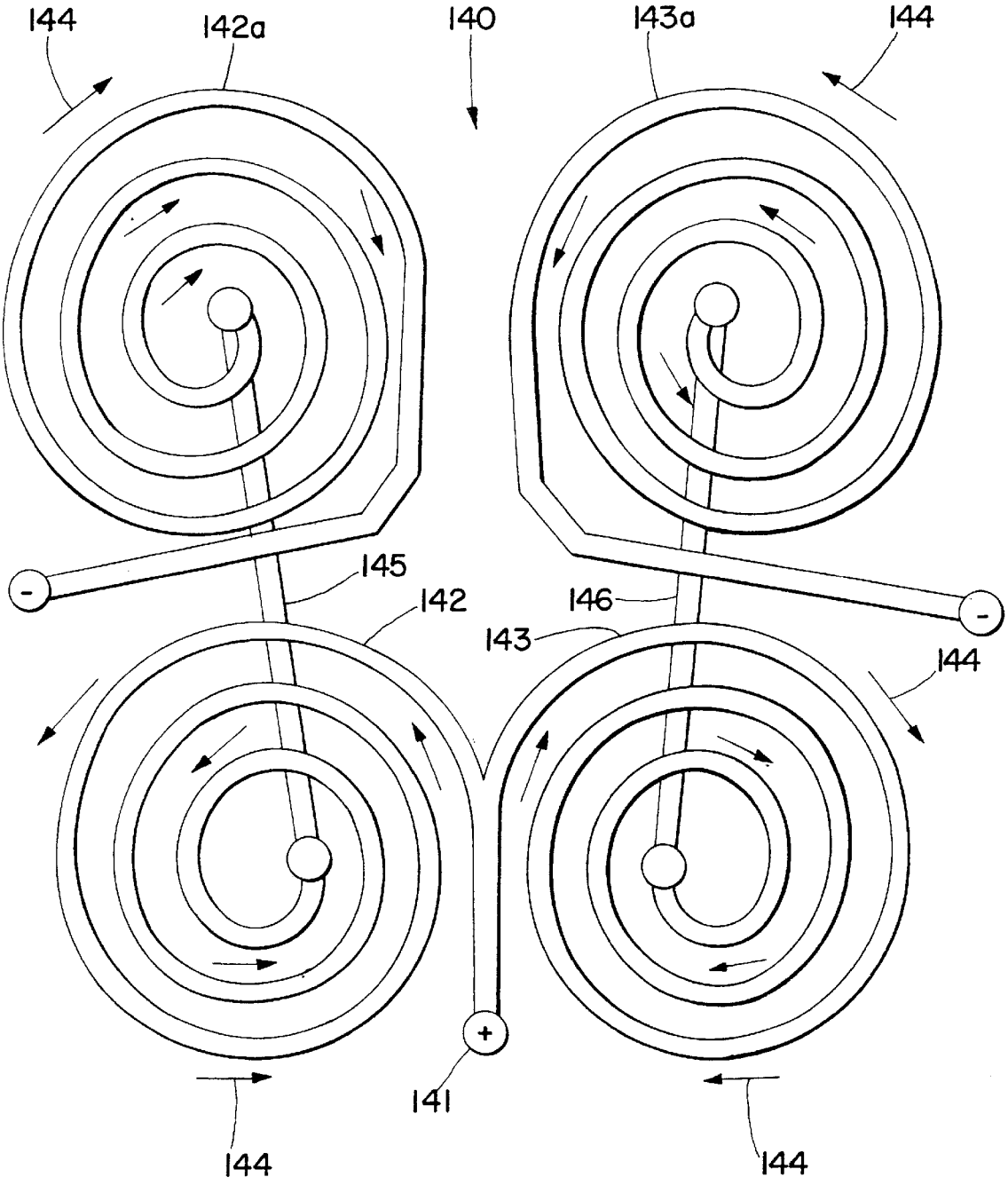
FIG. 4A is a plan view of yet another actuator coil in accordance with another embodiment of the present invention.

FIG. 4*a* shows a variation of the accuator coil arrangement shown in FIG. 4. in accordance with the present invention. FIG. 4*a* shows an actuator coil 140 comprising central conduit 41 which is split only once to form return conduit coils 142, 143, 142*a* and 143*a* in a series, connected by serial conduits 145 and 146 which connect, respectively, the centers of coil pairs 142 and 142*a*, and 143 and 143*a*. Serial conduits 145 and 146 as shown extend below the plane of the conduit coils. In this embodiment all four coils are shown as being co-planar, with coils 142*a* and 143*a* having straight portions extending toward the negative bus from their exterior and extending in the plane of the four return coils.

Yet another coil follows the fundamental principle of the present invention, that of splitting the pulse current in order to generate a magnetic field having a central high flux area. Such a coil is shown in plan view in FIG. 5. In this embodiment, the work piece is to be formed so as to have an asymmetric bulge (depending upon the energy input), and having an approximately isosceles triangular plan with two 6 inch edges 54 and 55 and one 7 inch edge 56. The coil for this shape was constrained to lie entirely within the plan view of the bulge. The coil 50 was cut in one piece from a 0.375 inch thick copper plate. The central conduit 51 of the coil is about 0.500 inch wide and bisects the angle between the 6.0 inch edges 52 and 53 starting at the 7.0 inch edge. Just short of the apex the conductor branches, forming separate legs running parallel to each 6.0 inch plan edge. At the 7.0 inch plan edge the return conduits 52 and 53 return the current pulse back toward the central conduit along a line parallel to the 7.0 inch edge. The legs reach about 0.375 inch from the central conduit 51 and then turn parallel to it. Each return conduit essentially forms a 270 degree coil within itself maintaining a 0.375 spacing from the outer loop.

The input and output leads are brazed at the ends of the branch legs and start of the central leg and are perpendicular to the plane of the coil. The coil was imbedded into a 3.0 inch thick layered plywood base 58 such that the face of the coil was flush with the top plywood sheet surface and the brazed lead bars extended from the bottom. Four straight legs supported the coil-base assembly at the proper height above the buss bars to allow unstrained connection of the lead bars to the busses with bolted angle bracket connectors. A female form tool (not shown) was positioned and secured by two tie rods running through the assembly outside of the test blank nesting area. The tie rods also provided the work piece clamping force required to restrain sheet draw-in and flange wrinkling.

The apparatus of the present invention was tested using the coils described above with a female form tool (die). The die, made from a polymer composite material, reproduced a corner of an automobile inner door panel stamping that had proved to be very difficult to form by conventional methods, The test corner part was successfully formed in 0.8 mm (0.032 inch) thick 6111-T4 aluminum with a discharge energy through the coil of 24.0 kilo-joules (kilowatt-sec). The maximum sheet displacement height from the flat blank surface was approximately 29 mm at which point the sheet experienced biaxial tension strain of 0.165 major and 0.104 minor. Spring-back of the part was qualitatively observed to be within acceptable limits for general automotive stampings.

Figure 5:
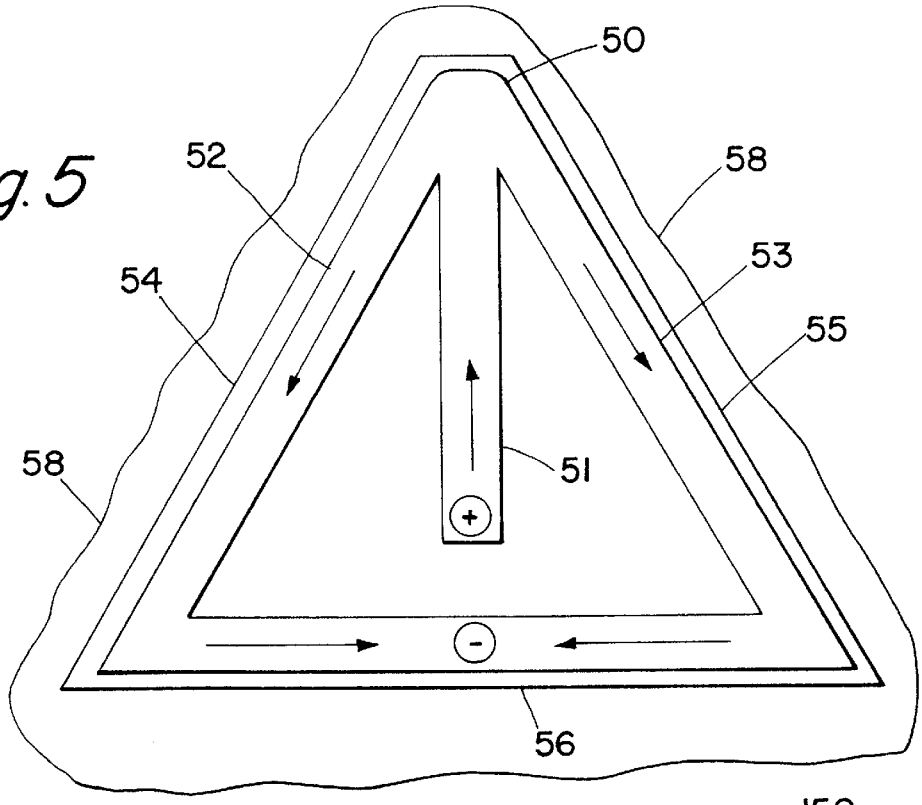
FIG. 5 is a plan view of yet another actuator coil in accordance with another embodiment of the present invention.
Figure 5A:
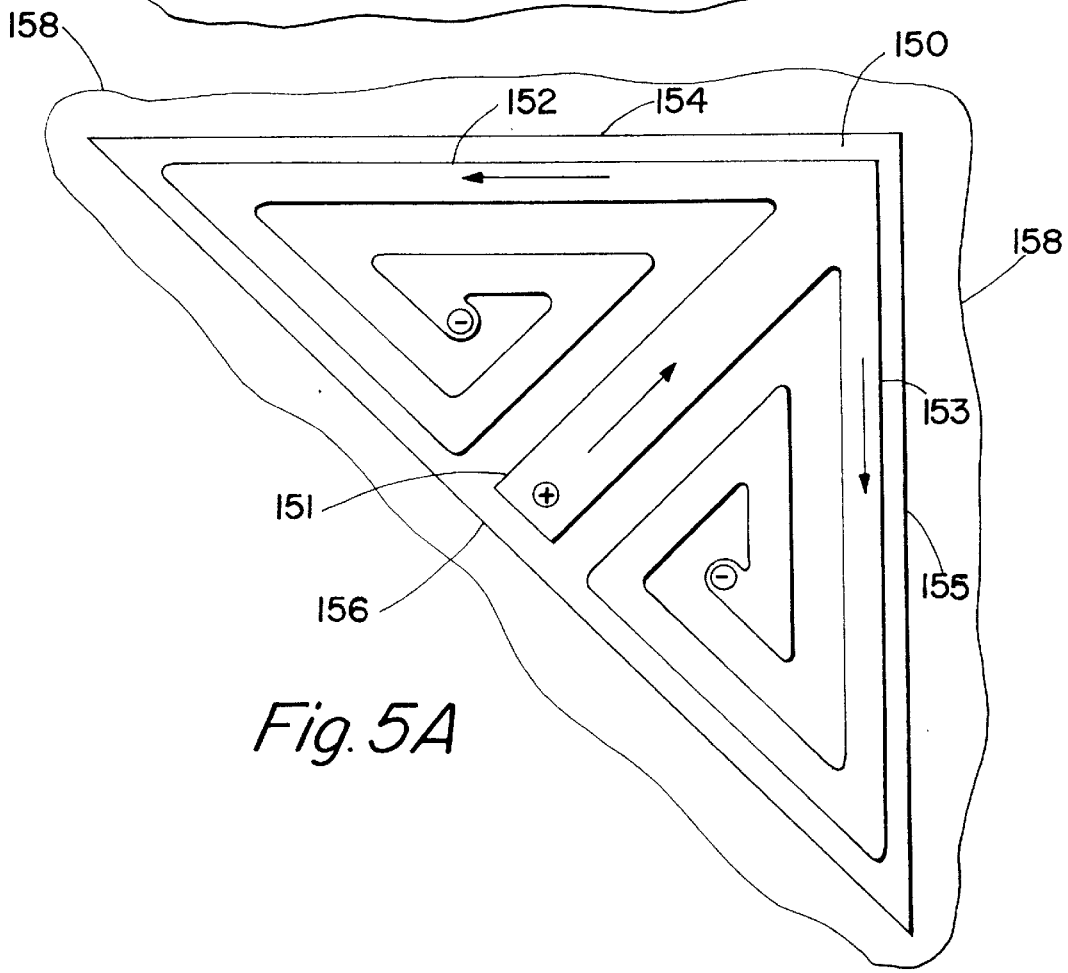
FIG. 5A is a plan view of yet another actuator coil in accordance with another embodiment of the present invention.

Another embodiment of the present invention shown in FIG. 5*a* is similar in overall geometric shape as that shown in FIG. 5. However, the embodiment shown in FIG. 5*a* features a split conduit to form coils each having a trigonal shape. This embodiment follows one of the fundamental principles of the present invention, that of splitting the pulse current in order to generate a magnetic field having a central high flux area. In this embodiment, the work piece is to be formed so as to have an asymmetric bulge (depending upon the energy input), and having an approximately isosceles triangular plan with two 6 inch edges 154 and 155 and one 8 inch edge 156. The coil for this shape was constrained to lie entirely within the plan view of the bulge. The coil 150 was cut in one piece from a 0.375 inch thick copper plate. The central conduit 151 of the coil is about 0.500 inch wide and bisects the angle between the 6.0 inch edges 152 and 153 starting at the 8.0 inch edge. Just short of the apex the conductor branches forming separate legs running parallel to each 6.0 inch plan edge, and then form trigonal coils on either side of the central conduit 151. The legs extend away from the central conduit 151 and then coil toward it.

The input and output leads are brazed at the ends of the branch legs and start of the central leg and are perpendicular to the plane of the coil. The coil was imbedded into a 3.0 inch thick layered plywood base 158 such that the face of the coil was flush with the top plywood sheet surface and the brazed lead bars extended from the bottom. Four straight legs supported the coil-base assembly at the proper height above the buss bars to allow unstrained connection of the lead bars to the busses with bolted angle bracket connectors. A female form tool (not shown) was positioned and secured by two tie rods running through the assembly outside of the test blank nesting area. The tie rods also provided the work piece clamping force required to restrain sheet draw-in and flange wrinkling.

Figure 6:
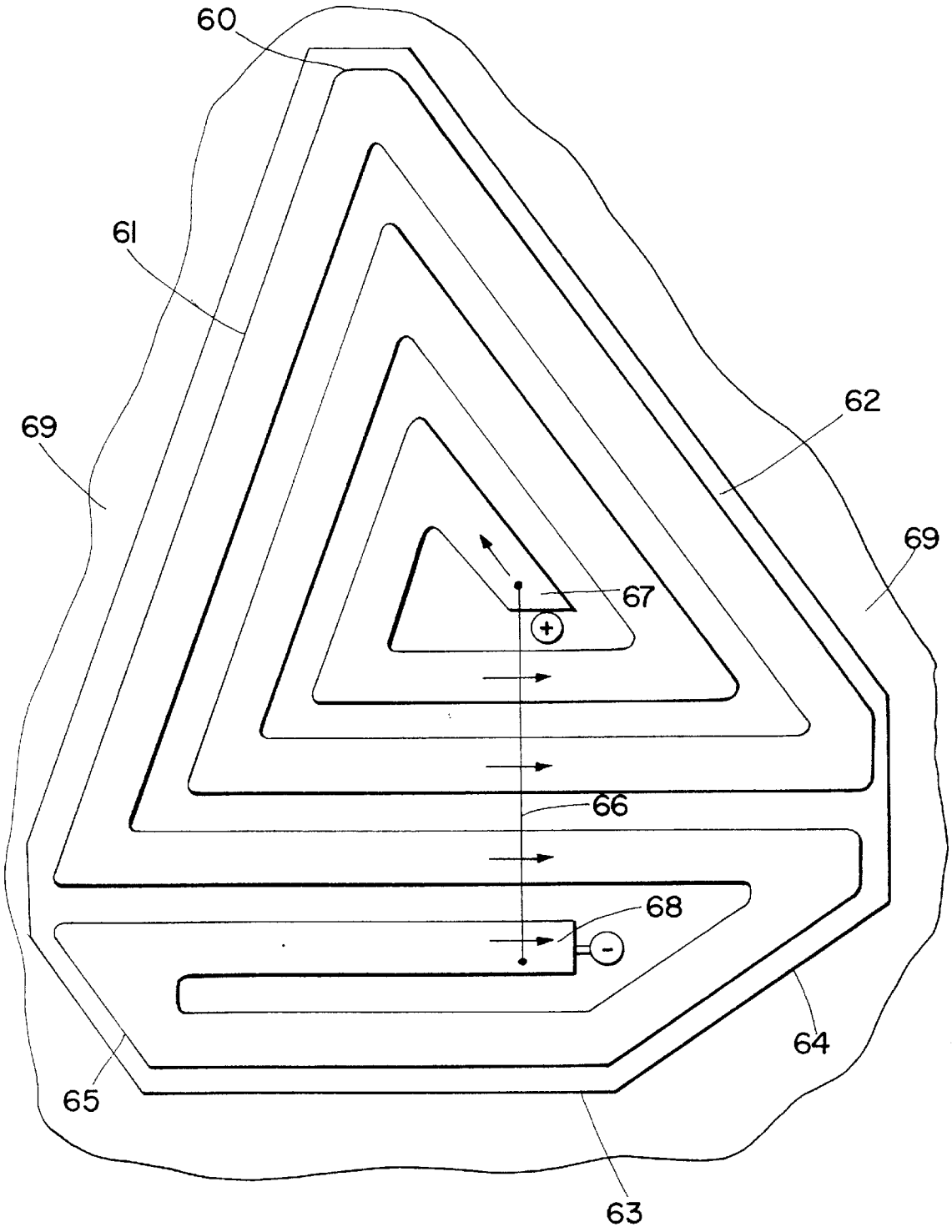
FIG. 6 is a plan view of yet another actuator coil in accordance with another embodiment of the present invention.

FIG. 6 shows still another coil 60 following another fundamental principle of the present invention, that of reversing the direction of the pulse current in the plane of the actuator coil in order to generate a magnetic field having a central high flux area. The piece to be formed by this actuator coil was to have an asymmetric bulge, 1.5 inches high and having an approximately equilateral triangular plan with 6 inch edges 61 and 62, with one side further bordering upon the longest side of a trapezoidal shape having a long side of about 6 inches, a shorter opposing side 63 of about 4 inches and lateral sides 64 and 65 of about 2 inches. The coil was constrained to lie entirely within the plan view of the bulge. The coil was cut in one piece from a 0.375 inch thick high strength aluminum plate. As can be appreciated from FIG. 6, this coil provides that the pulse (indicated by the directional arrows) running through those portions of the coil intersecting a line 66 between the input lead 67 and the output lead 68 are substantially parallel, causing there to be generated a magnetic field having a high flux in this central area (i.e., one that is substantially uninterrupted by zones having little or no flux).

The input and output leads are brazed at the ends of the branch legs and start of the central leg and are perpendicular to the plane of the coil. The coil was imbedded into a 3.0 inch thick layered plywood base 69 (as may any actuator coil of the present invention) such that the face of the coil was flush with the top plywood sheet surface and the brazed lead bars extended from the bottom. Four straight legs supported the coil-base assembly at the proper height above the buss bars to allow unstrained connection of the lead bars to the busses with bolted angle bracket connectors. A female form tool (not shown) was positioned and secured by two tie rods running through the assemble outside of the test blank nesting area. The tie rods also provided the work piece clamping force required to restrain sheet draw-in and flange wrinkling.

Figure 7:
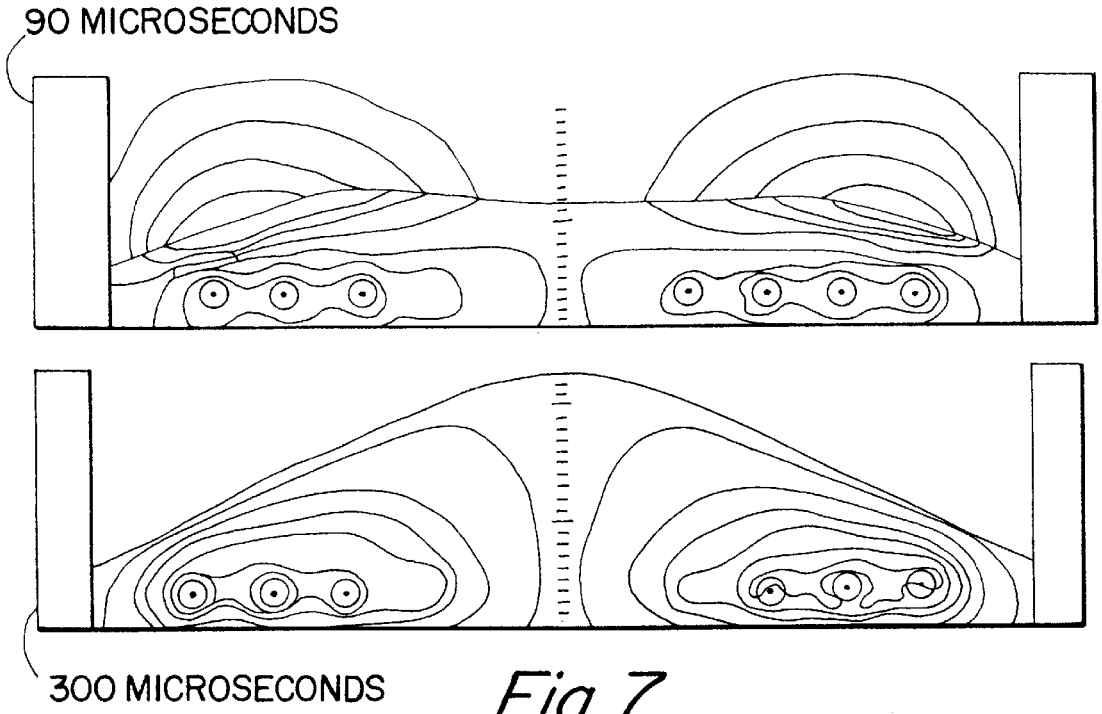
FIG. 7 is a computer-generated simulation of a sheet forming problem.

To illustrate the advantages of the present invention over the prior art, the stresses in electromagnetic forming and the velocity vs. Time profiles have been accurately predicted for expanding ring experiments using solenoid coils. Computer codes that can model more complex two dimensional problems are also available. CALE, a "C" language based code, originally developed at Lawrence Livermore National Laboratory as an astrophysics code, is now being used to model these forming processes and the subsequent material response. FIG. 7 shows an example of a CALE simulation of a sheet forming problem. A flat spiral coil is used to form a clamped metal sheet. The irregular lines indicate lines of magnetic flux around the current-carrying elements (shown in cross section) in the simulation. Two views from the simulation are shown as they would be at 90 and 300 microseconds. It is observed that the deformation begins at the edges of the sheet and progresses towards the center. The predicted time-profile of the deformation agrees with the profiled obtained with a high speed camera in a real experiment reported by others under similar conditions. CALE accurately simulates the trajectory and profile of the deforming sheet metal work piece. This simulation demonstrates that the maximum force from the traditional prior art coil is at its periphery. With the coils of the present invention, the maximum force region may be brought to bear on the center of the work piece.

Figure 8:
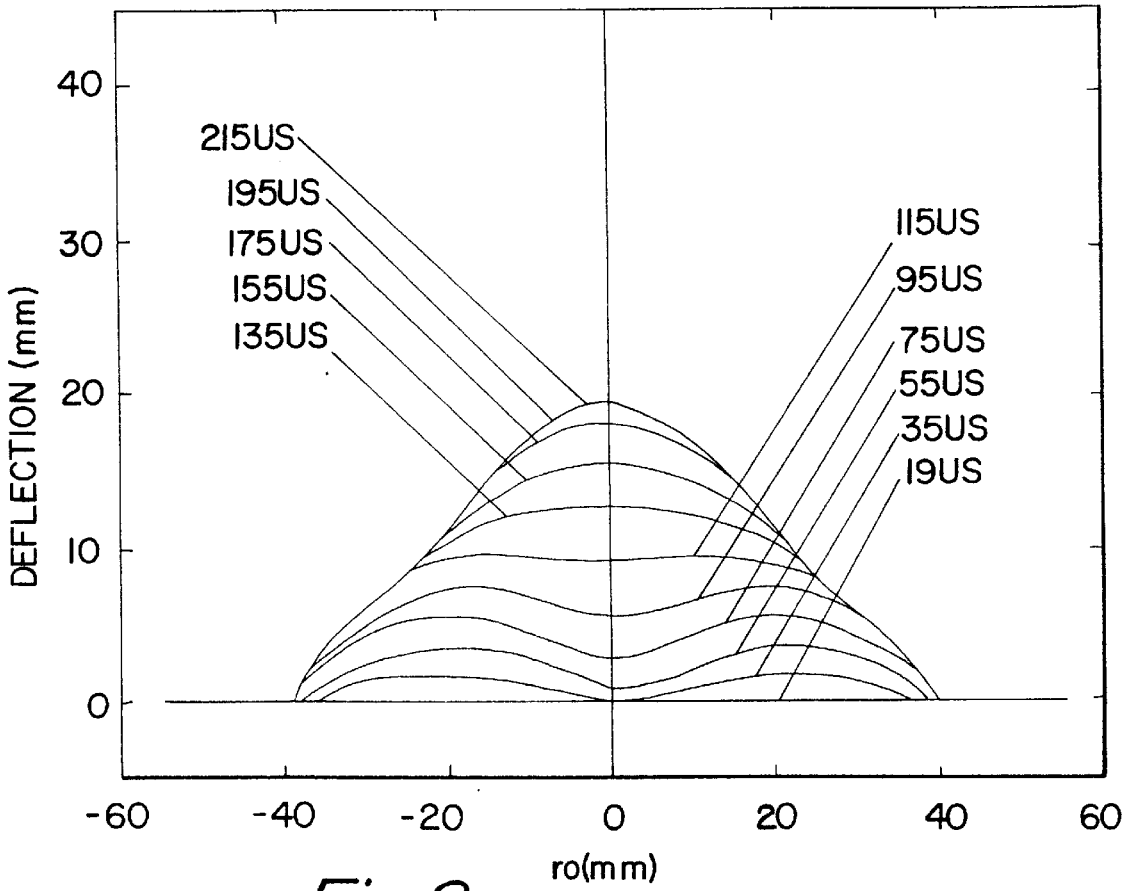
FIG. 8 shows a profile of a deforming sheet metal work piece.

FIG. 8 shows a profile of the sheet through the deformation process simulated in FIG. 7.

Though there are no fundamental limitations to the size of the parts that can be made by electromagnetic forming in accordance with the present invention, larger parts require more energy which translates into larger capacitor banks and higher initial capital expenditure. As a result, hybrid forming processes are also being considered where electromagnetic and electrohydraulic forming may be used in such a hybrid process. Accordingly, the present invention may also be used in a matched tool set with electromagnetic coils built into sharp corners and other difficult-to-form contours, to form such parts. The matched tools would form the parts of the work piece which can be easily formed at low velocities using mechanical energy from the press. This semi-formed work piece would then be subjected to high rate forming with the electromagnetic coils to complete the forming operation. A schematic of such a process is shown in FIG. 9.

Figure 9:
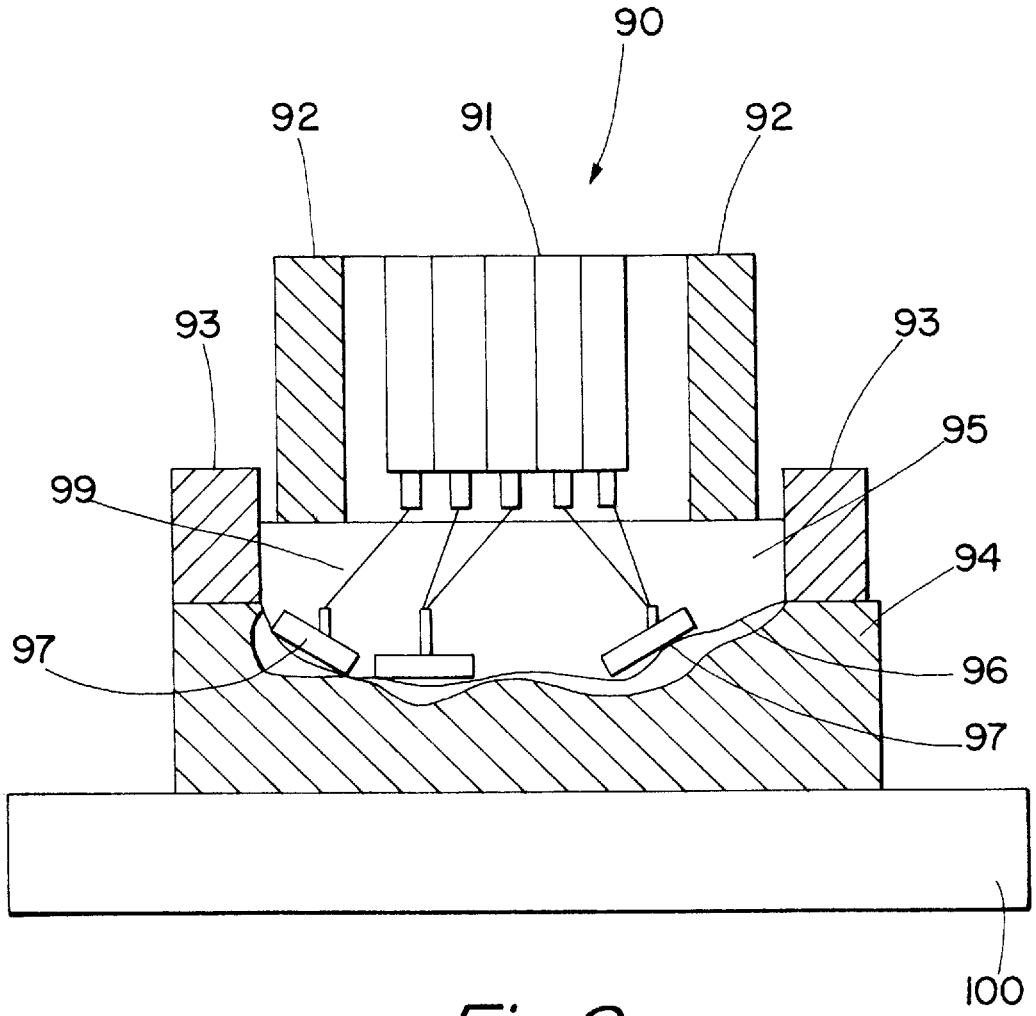
FIG. 9 shows a schematic of a hybrid matched tool electromagnetic forming apparatus with which actuator coils of the present invention may be used.

FIG. 9 shows hybrid matched tool-electromagnetic forming apparatus 90 including capacitor bank 91, inner ram 92, outer ram 93 with blank holder and die 94 (on press bolster 100. Stage 1 punch 95 partially forms work piece 96 leaving one or more portions partially formed. The actuator coils of the present invention, such as 97, powered by coaxial power distribution lines 99, may then be applied to fill out the remaining portions (indicated by voids such as 98), to reach the final desired shape of the work piece. Similarly, a quasi static, fluid pressure process with an electrical discharge in the fluid at the end of the pressure cycle to form the sharp comers and bends could represent another embodiment of the hybrid method of making difficult parts.

Industrial Applicability

Actuators of the present invention may find application in many industries that involve the formation of shaped metal pieces, such as in the making of parts for the automobile industry aerospace and the boat manufacture industry. Other applications may be found in the making of specially shaped parts in wide variety of other industries as well.

In view of the foregoing disclosure, it will be within the ability of one of ordinary skill in the art to make modifications to the present invention, such as through equivalent alternative mechanical arrangements and/or the integration or separation of component parts, without departing from the spirit of the invention as reflected in the appended claims.

What is claimed is:

1. An apparatus for forming a metal work piece, said apparatus comprising:

(a) an electromagnetic actuator comprising a central current conduit, said central current conduit adapted to conduct a current pulse, and adapted to divide said current pulse so as to provide a divided current pulse, and a return current conduit adapted to conduct said divided current pulse to an electrical ground; and (b) a current power source adapted to produce a current pulse through said electromagnetic actuator so as to produce a magnetic field.

2. An apparatus according to claim 1 wherein said central conduit is adapted to divide said current pulse by being in the form of a mold body defining a mold shape against which said metal work piece is deformed.

3. An apparatus for forming a metal work piece, said apparatus comprising:

(a) an electromagnetic actuator comprising a central current conduit, said central current conduit adapted to conduct a current pulse in a first current direction and having first and second sides, and a third side perpendicular to a direction between said first and second sides, said central current conduit divided into at least two return current conduits, at least one of said at least two return current conduits extending along a first and second side of said central current conduit and adapted to conduct said current pulse in a second direction to an electrical ground; and (b) a current power source adapted to produce a current pulse through said electromagnetic actuator, so as to produce a magnetic field in a work force area on said third side of said central current conduit.

4. An apparatus according to claim 3 wherein said central current conduit and said at least two return current conduits have at least one of the following characteristics: (1) said central current conduit and said at least two return current conduits are substantially coplanar, (2) said at least two return current conduits form substantially planar coils, (3) said central current conduit and said at least two return current conduits are linear and substantially coplanar, (4) said central current conduit and said at least two return current conduits are linear, substantially coplanar and parallel, and (5) said central current conduit and said at least two return current conduits are curvilinear and substantially parallel.

5. An apparatus according to claim 3 wherein said central current conduit and said at least two return current conduits form an elongate work force area having a longitudinal axis extending substantially parallel to said central current conduit.

6. An apparatus according to claim 3 additionally comprising (c) a work piece holder adapted to hold said metal work piece along said third side of said central current conduit and in such proximity to said central current conduit such that said magnetic field causes the deformation of said metal work piece.

7. An apparatus according to claim 6 wherein said work piece holder comprises a mold body defining a mold shape against which said metal work piece is deformed.

8. An apparatus according to claim 6 wherein said work piece holder comprises a first half adapted to fit along said third side of said actuator so as to hold said metal work piece between said actuator and said first half, and a second half adapted to fit along a fourth side of said actuator opposite said third side.

9. A method of forming a metal work piece, said method comprising the steps:

(a) obtaining a metal work piece, said work piece having an original shape;

(b) disposing said metal work piece in the work force area of an electronic actuator, said actuator comprising:

(i) an electromagnetic actuator comprising a central current conduit, said central current conduit adapted to conduct a current pulse in a first current direction and having first and second sides, and a third side perpendicular to a direction between said first and second sides, said central current conduit divided into at least two return current conduits, at least one of said at least two return current conduits extending along a first and second side of said central current conduit and adapted to conduct said current pulse in a second direction to an electrical ground; and (ii) a current power source adapted to produce a current pulse through said actuator, so as to produce a magnetic field in said work force area on said third side of said central current conduit; and (c) causing a current pulse to pass through said actuator, sufficient to produce a magnetic field of sufficient strength to deform said metal work piece from said original shape to another shape.

10. A method according to claim 9 wherein said central current conduit and said at least two return current conduits have at least one of the following characteristics: (1) said central current conduit and said at least two return current conduits are substantially coplanar, (2) said at least two return current conduits form substantially planar coils, (3) said central current conduit and said at least two return current conduits are linear and substantially coplanar, (4) said central current conduit and said at least two return current conduits are linear, substantially coplanar and parallel, and (5) said central current conduit and said at least two return current conduits are curvilinear and substantially parallel.

11. A method according to claim 9 wherein said central current conduit and said at least two return current conduits form an elongate work force area having a longitudinal axis extending substantially parallel to said central current conduit.

12. A method according to claim 9 wherein said actuator additionally comprises a work piece holder adapted to hold said metal work piece along said third side of said central current conduit and in such proximity to said central current conduit such that said magnetic field causes the deformation of said metal work piece.

13. A method according to claim 12 wherein said work piece holder comprises a mold body defining a mold shape against which said metal work piece is deformed.

14. A method according to claim 12 wherein said work piece holder comprises a first half adapted to fit along said third side of said actuator so as to hold said metal work piece between said actuator and said first half, and a second half adapted to fit along a fourth side of said actuator opposite said third side.

15. A metal work piece formed from an original shape into another shape in accordance with the method of claim 9.

16. An apparatus for forming a metal work piece, said apparatus comprising:

(a) an electromagnetic actuator comprising a current conduit, said current conduit defining a current path having a shape, said shape comprising:

(i) a current pulse origin;

(ii) a first current coil portion coiling outward from said current pulse origin, said first current coil portion coiling in a first direction;

(iii) a direction reversing portion; and (iv) a second coil portion coiling inward to an electrical ground;

such that the direction of said current pulse carried by said direction reversing portion and those portions of said first and second coil portions that intersect a line connecting said current pulse origin and said electrical ground, are substantially parallel; and (b) a current power source adapted to produce a current pulse through said electromagnetic actuator, so as to produce a magnetic field.

17. A method of forming a metal work piece, said method comprising the steps:

(a) obtaining a metal work piece, said work piece having an original shape;

(b) disposing said metal work piece in the work force area of an electronic actuator, said actuator comprising:

(i) an electromagnetic actuator comprising a current conduit, said current conduit defining a current path having a shape, said shape comprising:

(1) a current pulse origin;

(2) a first current coil portion coiling outward from said current pulse origin, said first current coil portion coiling in a first direction;

(3) a direction reversing portion; and (4) a second coil portion coiling inward to an electrical ground;

such that the direction of said current pulse carried by said direction reversing portion and those portions of said first and second coil portions that intersect a line connecting said current pulse origin and said electrical ground, are substantially parallel; and (ii) a current power source adapted to produce a current pulse through said electromagnetic actuator, so as to produce a magnetic field; and (c) causing a current pulse to pass through said actuator, sufficient to produce a magnetic field of sufficient strength to deform said metal work piece from said original shape to another shape.

18. A metal work piece formed from an original shape into another shape in accordance with the method of claim 7.

19. An apparatus for forming a metal work piece, said apparatus comprising:

(a) an electromagnetic actuator comprising a central current conduit, said central current conduit adapted to conduct a current pulse, and extending longitudinally so as to conduct a current pulse along a linear or arcuate path, and a return current conduit adapted to conduct said current pulse to an electrical ground; and (b) a current power source adapted to produce a current pulse through said electromagnetic actuator so as to produce a magnetic field.

20. An apparatus according to claim 19 wherein said central conduit is in the form of a mold body defining a mold shape against which said metal work piece is deformed.

21. An apparatus according to claim 19 additionally comprising (c) a work piece holder adapted to hold said metal work piece alongside said central current conduit and in such proximity to said central current conduit such that said magnetic field causes the deformation of said metal work piece.

22. An apparatus according to claim 21 wherein said work piece holder comprises a mold body defining a mold shape against which said metal work piece is deformed.

23. An apparatus according to claim 21 wherein said work piece holder comprises a first half adapted to fit along a first side of said actuator so as to hold said metal work piece between said actuator and said first half, and a second half adapted to fit along a second side of said actuator opposite said first side.

24. A method of forming a metal work piece, said method comprising the steps:

(a) obtaining a metal work piece, said work piece having an original shape;

(b) disposing said metal work piece in the work force area of an electronic actuator, said actuator comprising:

(i) an electromagnetic actuator comprising a central current conduit, said central current conduit adapted to conduct a current pulse, and extending longitudinally so as to conduct a current pulse along a linear or arcuate path, and a return current conduit adapted to conduct said current pulse to an electrical ground; and (ii) a current power source adapted to produce a current pulse through said electromagnetic actuator so as to produce a magnetic field; and (c) causing a current pulse to pass through said actuator, sufficient to produce a magnetic field of sufficient strength to deform said metal work piece from said original shape to another shape.

25. An method according to claim 24 wherein said central conduit is in the form of a mold body defining a mold shape against which said metal work piece is deformed.

26. An method according to claim 24 additionally comprising (c) a work piece holder adapted to hold said metal work piece alongside said central current conduit and in such proximity to said central current conduit such that said magnetic field causes the deformation of said metal work piece.

27. An method according to claim 26 wherein said work piece holder comprises a mold body defining a mold shape against which said metal work piece is deformed.

28. An method according to claim 26 wherein said work piece holder comprises a first half adapted to fit along a first side of said actuator so as to hold said metal work piece between said actuator and said first half, and a second half adapted to fit along a second side of said actuator opposite said first side.

29. A metal work piece formed from an original shape into another shape in accordance with the method of claim 24.

* * * * *

UNITED STATES PATENT AND TRADEMARK OFFICE

CERTIFICATE OF CORRECTION

PATENT NO. : 5,860,306

DATED : January 19, 1999

INVENTOR(S) : Daehn et al.

It is certified that error appears in the above-identified patent and that said Letters Patent is hereby corrected as shown below:

In Column 1, line 46, please delete the word "aet" and insert -- et --

In Column 1, line 58, please insert "-" between the words "work" and "coil"

Signed and Sealed this

Fourteenth Day of September, 1999

*Attest:*

Q. TODD DICKINSON

*Attesting Officer*

*Acting Commissioner of Patents and Trademarks*